US006740859B1

(12) United States Patent
Wojcik et al.

(10) Patent No.: US 6,740,859 B1
(45) Date of Patent: May 25, 2004

(54) FRACTIONAL SUBSTRACTION RESISTIVE READOUT FOR POSITION SENSITIVE PHOTO-MULTIPLIER TUBES

(75) Inventors: Randolph F. Wojcik, Yorktown, VA (US); Vladimir E. Popov, Newport News, VA (US)

(73) Assignee: Southeastern Univ. Research Assn., Inc., Newport News, VA (US)

( * ) Notice: Subject to any disclaimer, the term of this patent is extended or adjusted under 35 U.S.C. 154(b) by 45 days.

(21) Appl. No.: 10/213,835

(22) Filed: Aug. 6, 2002

(51) Int. Cl.[7] ..... H01J 40/14

(52) U.S. Cl. ..... 250/214 A; 250/214 LA; 330/308

(58) Field of Search ..... 250/214 A, 214 LA, 250/214 R, 214 C, 214 L; 330/253, 255, 261, 59, 110, 308; 327/514

(56) References Cited

U.S. PATENT DOCUMENTS 5,337,008 A * 8/1994 Badyal ..... 330/253

5,880,638 A * 3/1999 Schaffer ..... 330/255

* cited by examiner

*Primary Examiner*—Kevin Pyo

(57) ABSTRACT

A readout circuit for an imaging detector that improves resolution and increases field of view in a display compared to traditional readout circuits. The readout circuit comprises two or more amplifiers that receive a row or column of outputs from the imaging detector. Subtraction circuitry, included in the readout circuit, receives the signals from the amplifiers, determines a fractional value of the sum of the signals, and subtracts the fractional value from each signal thereby producing both positive and negative signals. A rail to rail amplifier operating from a signale voltage supply eliminates one polarity of the signals making the signals unipolar. A combining circuit receives the unipolar signals and combines them to produce two readout circuit outputs that are transmitted to a computer to be displayed.

18 Claims, 8 Drawing Sheets

FRACTIONAL SUBSTRACTION RESISTIVE READOUT FOR POSITION SENSITIVE PHOTO-MULTIPLIER TUBES

BACKGROUND OF THE INVENTION

The present invention relates generally to readout systems for imaging detectors, and more specifically to a readout systems that provides improved resolution and increased field of view for imaging detectors such as PS-PMT's.

A Position Sensitive Photo-Multiplier Tube (PS-PMT) is an imaging detector that converts light photons into an electrical current. The main components of a PS-PMT are an input window, a photocathode, focusing electrodes, dynodes and at least one anode (output). The photocathode is used for converting incoming light (photons) into electrons. These photoelectrons, which are a product of photoelectric effect, are directed by the potential of focusing electrodes towards dynodes. The dynodes are used to multiply the electrons by the process of secondary electron emission. Electron gains of $10^3$ to $10^8$ are common and depend on the number of dynodes and inter-dynode potentials. Dynodes are made of or covered with a layer of secondary emissive material. The condition of the dynode surfaces are responsible for PS-PMT stable gain performance.

The voltages that create the electrostatic fields between the photocathode, the focusing electrodes and the dynodes are delivered from a single high-voltage stable power supply and a voltage divider. The divider is a common part of a PS-PMT base. The design of the divider circuit is crucial to getting the best performance from the PS-PMT. There are many versions of PS-PMT high voltage dividers optimized or designed for some particular application. Most of them are concentrated on specific parameters that are critical for a given application, such as maximum gain, dynamic range, low noise, or linearity.

Series-regulator type high voltage power supplies optimized for photomuliplier tubes are well known in the art and have gained a good reputation. Other components found in or required by scintillation cameras, PS-PS-PMTs, are described in "Photomultiplier Tube, Principle to Application" by Hamamatsu Photonics K. K, March 1994, which is incorporated herein by reference.

The output of a photomuliplier tube is a current (charge), while the external signal processing circuits are usually designed to handle a voltage signal. Therefore, the current output must be converted into a voltage signal by a current to voltage converter. Further, the current that is output from a PS-PMT anode is very small, especially in low light level detection, low gain PS PMT's, and photon counting applications. An operational amplifier can be used to both convert the anode output current to a voltage and accurately amplify the resulting voltage. Typically this operational amplifier is powered by a source that is separate from the high voltage power source for the dynode stages of the PS-PMT. This is done to insure the stability of the power supply to the dynodes.

PS-PMTs generally have multiple anode outputs that are arranged in arrays with X number of rows and Y number of columns. The analog signal outputs from the anodes can be processed individually or combined in a variety of ways and the results analyzed using appropriate data acquisition systems under computer control. The highest resolution readout systems process each anode output individually. These individual wire readout systems provide high quality display information, however, they also require large numbers of circuits, wires and cables. The physical space requirements of individual wire readouts becomes prohibitive for larger arrays. These systems also produce extremely large amounts of data for the associated software to process. Another traditional readout system uses charge division resistor chains to combine the outputs of the rows and columns. This traditional readout system reduces the number of outputs from each row and each column to two. Such systems reduce the amount of required circuits, wires and cables, and the amount of data to be processed. However, this system also reduces resolution and field of view compared to individual wire readout systems. Processed data from readout systems can then be displayed on a video monitor for further study of the subject being imaged.

What is needed is a readout system that requires a small amount of circuits, wires and cables, like the traditional charge division resistor chain system, but one that also provides high resolution and does not decrease the field of view like the individual wire readout system.

SUMMARY OF THE INVENTION

A readout circuit, for an imaging detector, that improves resolution and increases the field of view in a display. The readout circuit comprises a fractional subtraction circuit and rail to rail amplifiers which only allow signals of one polarity to be transmitted to a combining circuit. The combining circuit receives the unipolar signals and combines them to produce two readout circuit outputs. The outputs are then sent to the display.

The readout circuits are advantageously used in an imaging detector that comprises one or more pairs of readout circuits, wherein each pair of readout circuits comprises an X readout circuit and a Y readout circuit. Each X readout circuit receiving a row of outputs from an imaging detector and each Y readout circuit receiving a column of outputs from the imaging detector.

In one embodiment the combining circuit is a resistive charge division circuit. In an alternative embodiment the combining circuit is a weighted summing circuit. The number of outputs received from the imaging detector is typically 200 or less, however the number of outputs from each readout circuit remains constant at two.

It is an object of the present invention to provide a readout system with resolution as good as an individual wire readout system but without requiring as many circuits, wires and cables as individual wire readout systems.

It is another object of the present invention to provide a readout system that provides resolution as good as an individual wire readout system but without generating as much data that must be processed as individual wire readout systems.

It is a further object of the present invention to increase the field of view of a display for a readout circuit that uses a combining circuit such as a charge division resistive chain.

BRIEF DESCRIPTION OF THE DRAWINGS

The invention of the present application will now be described in more detail with reference to the accompanying drawings, given only by way of example, in which.

DETAILED DESCRIPTION OF THE INVENTION

Figure 1:
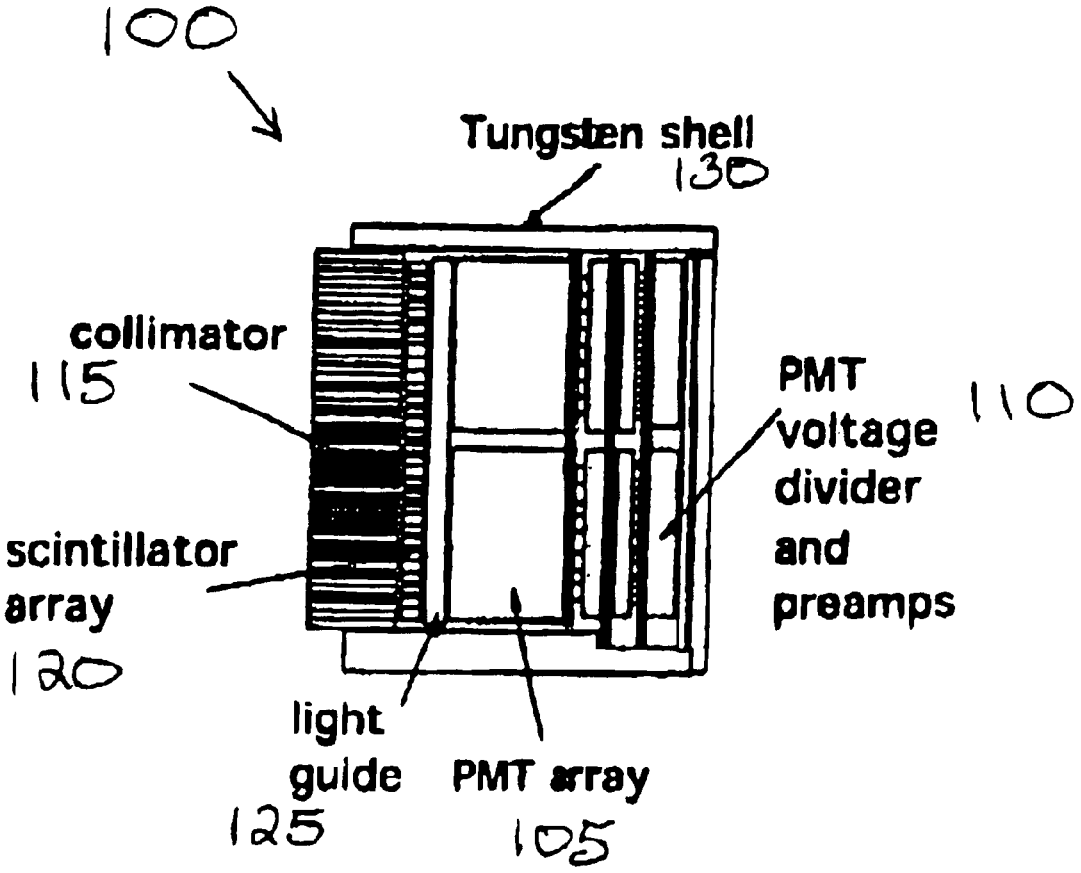
PRIOR ART Figure 1
FIG. 1 shows an exemplary imaging detector.

FIG. 1 shows an exemplary image detector 100 that can be used to provide inputs to the present readout system. The detector 100 comprises a two by two array of Photo-Multiplier Tubes (PMTS) 105. Array 105 helps convert light photons into electric current signals and outputs these signals, indicative of a detected image, through PMT voltage divider and preamps 110. Gamma ray photons enter collimator 115 and are directed to scintillator array 120 which converts the gamma ray photons Into visible light photons. Light guide 125 ensures that the light photons make it to the PMT array 105. The present invention reduces the amount of readout hardware and software required to provide high resolution images and to increase the field of view in a display device for image detectors such as detector 100. The present readout system has been tested on the Hamamatsu R7600-00-C8 PMT, which is shown as detector 100 in FIG. 1, and on the Hamamatsu R3941 PMT.

Figure 2:
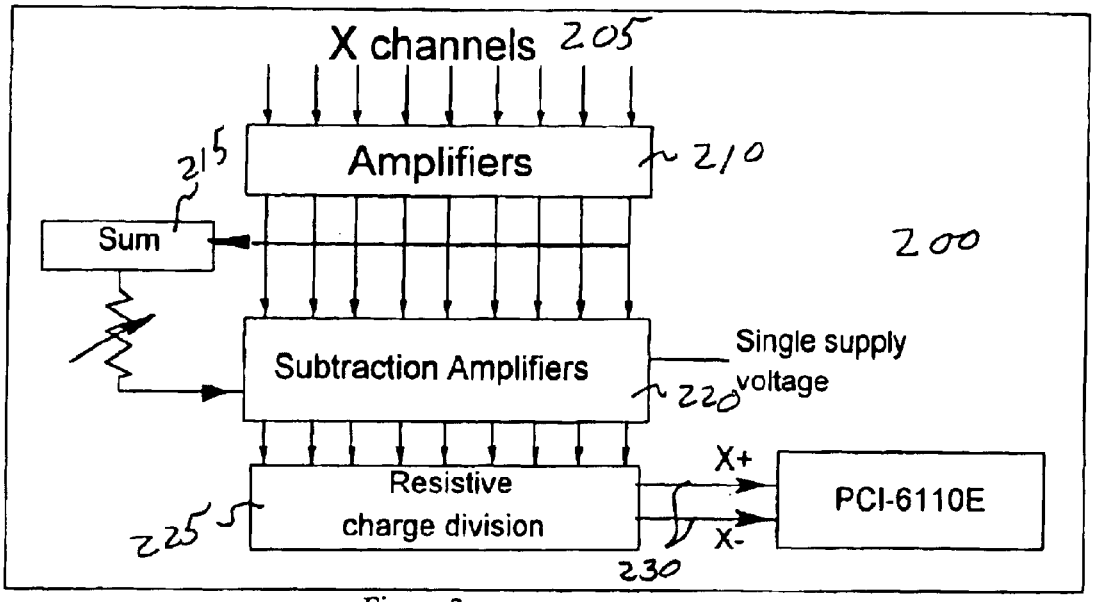
FIG. 2 is a block diagram of an exemplary readout circuit.

FIG. 2 shows an exemplary embodiment of the present readout circuit 200. In operation, each readout circuit is electrically connected to a row or a column of wires that provides output signals from the image detector. In FIG. 2, a row of signals 205 (X channels) are received from an imaging detector, such as detector 100. Amplifiers 210 amplify the signals and splits the signals sending half of each signal to inverting summing circuit 215, which produces an inverted sum of the signals. The other half of each signal, along with a fraction of the inverted sum, is sent to subtraction circuit 220. This results in signals which may have both positive and negative parts. In order to combine the signals in a manner that increases the field of view, one polarity of these signals must be eliminated. This is done using rail to rail amplifiers powered by only a single (positive or negative) voltage supply, rather than the usual dual (positive and negative) power supply. Since there is no voltage to power one of the polarities in the signal, it is eliminated. Rail to rail amplifiers allow the acceptance of signals all the way down to zero volts, rather than the one or more volts standard amplifiers can accept; which would greatly degrade the image quality. The unipolar signals are then sent to a combining circuit such as resistive charge division circuit 225, which combines the signals and produces two output signals, X+ and X−, 230. This same circuit 200 is also used to receive and process columns of signals from the image detector and produce two column outputs, Y+ and Y−. The output signals from one or more readout circuits are then sent to a sampling card, such as PCI-6110E, in a computer and subsequently to a display for viewing. In this embodiment, the sum of one of the coordinates is used to act as a trigger.

Figure 3:
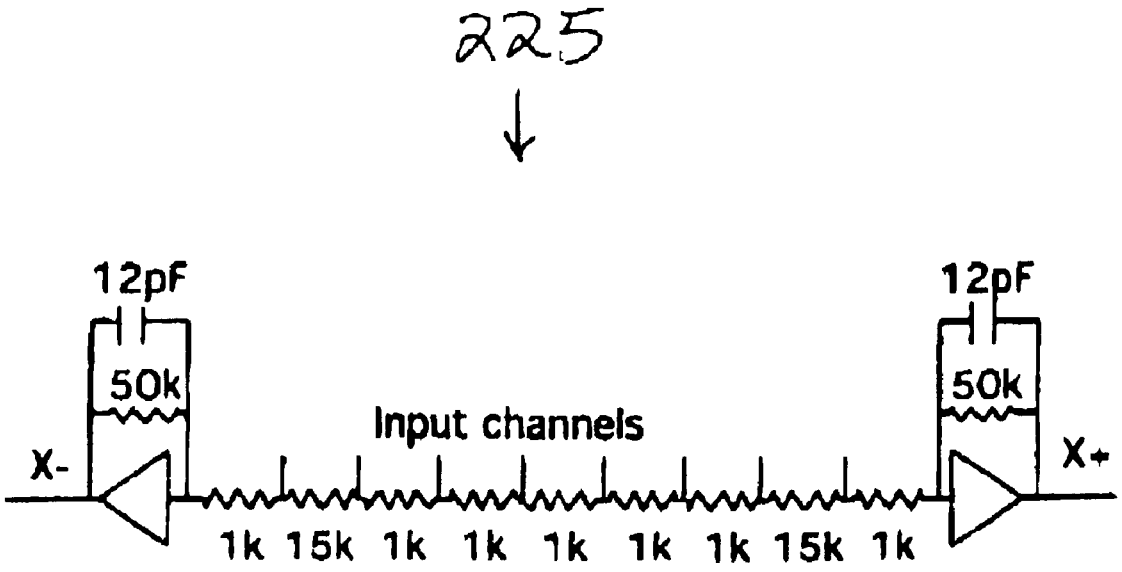
FIG. 3 is a circuit diagram of an exemplary combining circuit.

FIG. 3 shows the circuit design, in one embodiment, for combining circuit 225. Combining circuit 225, which is a charge division resistive chain circuit, is preferably used in the present readout circuit when the number of channels from the image detector is 12 or less. A combining circuit for use in the present system when more than 12 channels are to be processed, is described further below. In FIG. 3 the input channels are the unipolar signals. Circuit 225 combines the signals and produces two outputs, X− and X+.

Figure 4:
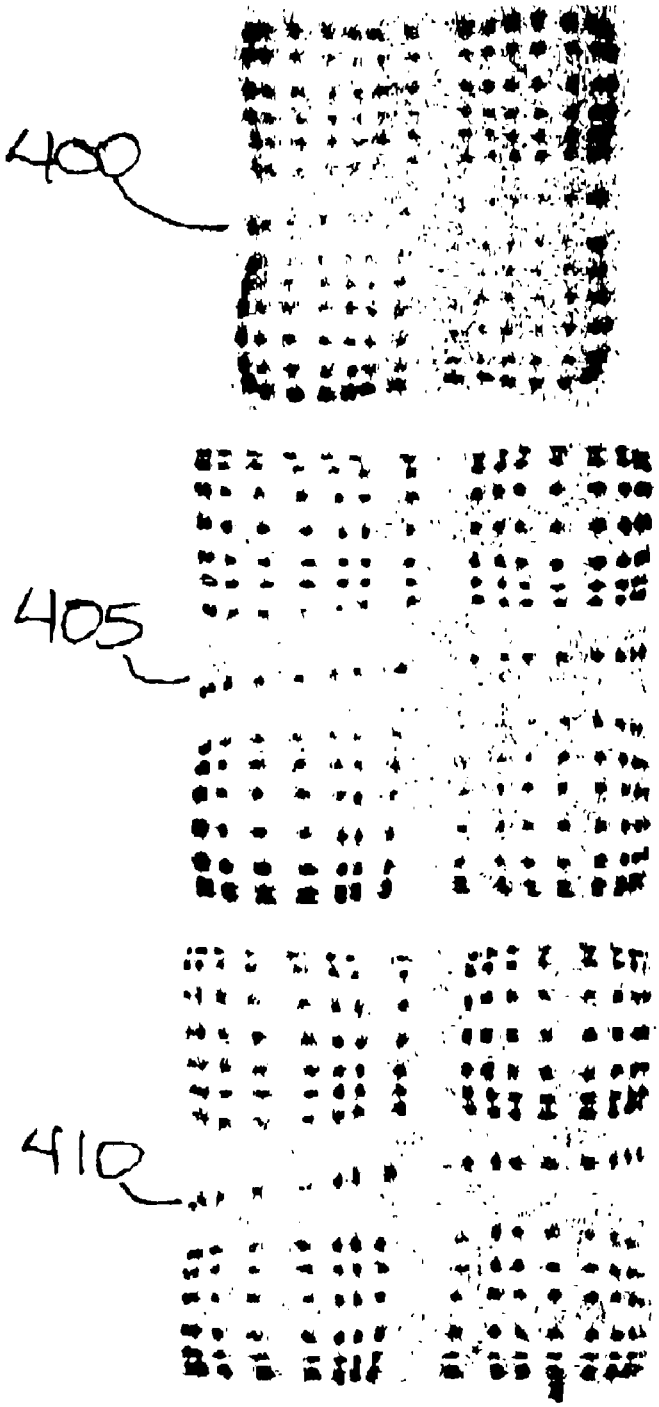
FIG. 4 shows displays from three different readout systems.

The present readout system uses as little hardware and software as a traditional charge division readout systems, and provides better resolution and field of view. The present readout system requires substantially less hardware and software than individual wire readout systems, and provides display resolution and field of view just as good as individual wire systems. FIG. 4 provides evidence of these assertions. Display 400 is the display of a traditional charge division readout system; a system that uses approximately the same amount of hardware and software as the present system. Display 405 is the display of the present readout system. Display 410 is the display of an individual wire readout system; a system that requires substantially more hardware and software than the present system. As can be seen in FIG. 4, display 405 has better resolution and field of view than display 400. Further, display 405 has just as good resolution and field of view as display 410. In all cases the data acquisition programs were based on Sparrow's KMAX software that was executed on an Apple Macintosh G3.

Figure 5:
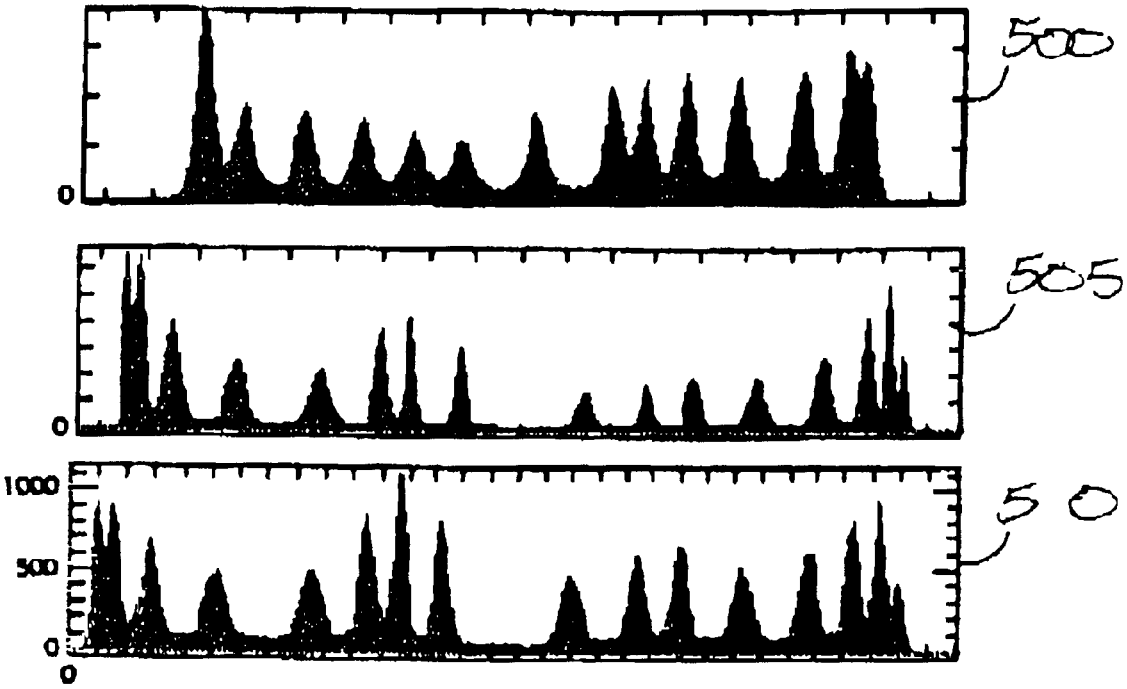
FIG. 5 shows profiles of one row in each of the same three readout systems.

FIG. 5 shows profiles cut across a row of pixels for each display in FIG. 4. Profile 500 is the profile of a row from a traditional charge division readout system; a system that uses approximately the same amount of hardware and software as the present system. Profile 505 is the profile of a row from the present readout system. Profile 510 is the profile of a row from an individual wire readout system; a system that requires substantially more hardware and software than the present system. One indication of good resolution is deep valleys in the profiles, this indicates low levels of noise. Directly related to field of view is the number of peaks visible on any profile, with more peaks indicating greater field of view. As can be seen in FIG. 5, profile 505 has deeper valleys and two more peaks than profile 500; indicating better resolution and two more pixels per row, i.e., greater field of view. Profile 505 also has a similar peak to valley ratio and the same number of peaks as profile 510; indicating similar resolution and field of view as an Individual wire readout system. In all cases the data acquisition programs were based on Sparrow's KMAX software that was executed on an Apple Macintosh G3.

Figure 6:
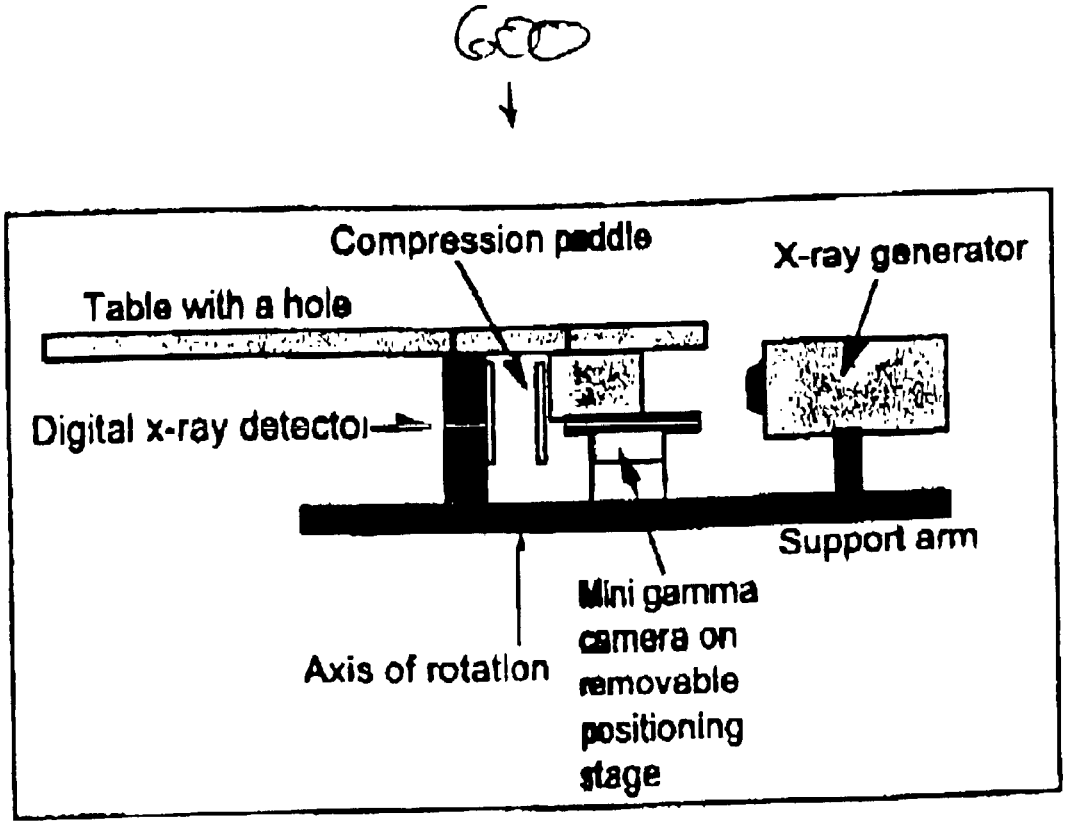
FIG. 6 show an exemplary application of an imaging detector.

FIG. 6 shows an exemplary application for the present system. Application 600 is for mammogram x-rays. The mini-gamma camera mounted on a removable positioning stage is a PMT based camera that could used to provide inputs to the present readout system. The other portions of the x-ray table are self-explanatory and a description of each is not required for an understanding of the present readout system. FIG. 6 is primarily intended to provide a "big picture" understanding of the present system.

Figure 7:
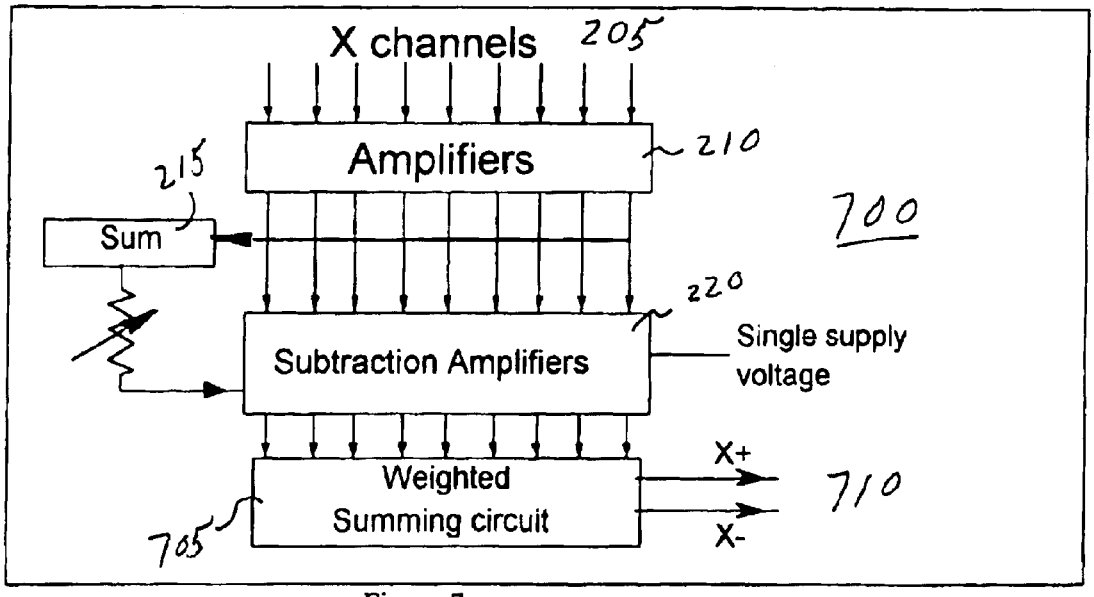
FIG. 7 shows an alternative embodiment of the combining circuit.

FIG. 7 is an alternative embodiment showing the preferred combining circuit 700 to be used in the readout circuit when more than 12 signals from the image detector are to be processed. A row of signals 205 (X channels) are received from an imaging detector. Amplifiers 210 amplify the signals and splits the signals sending half of each signal to inverting summing circuit 215, which produces an inverted sum of the signals. The other half of each signal is sent to subtraction circuit 220. A fraction of the inverted sum, set by a potentiometer, is also sent to subtraction circuit 220. The fraction of the inverted sum is subtracted from each signal in subtraction circuit 220. This results in bipolar signals which are sent to rail to rail amplifiers operating from a single voltage supply which eliminates one of the polarities of the signal. The unipolar signals in this embodiment are then sent to combining circuit 705, which is a weighted summing circuit that combines the signals and produces two output signals, X+ and X−, 710. This same circuit 700 is also used to receive and process columns of signals from the Image detector and produce two column outputs, Y+ and Y−. The output signals from the readout circuits are then sent to a computer to be displayed for viewing.

Figure 8:
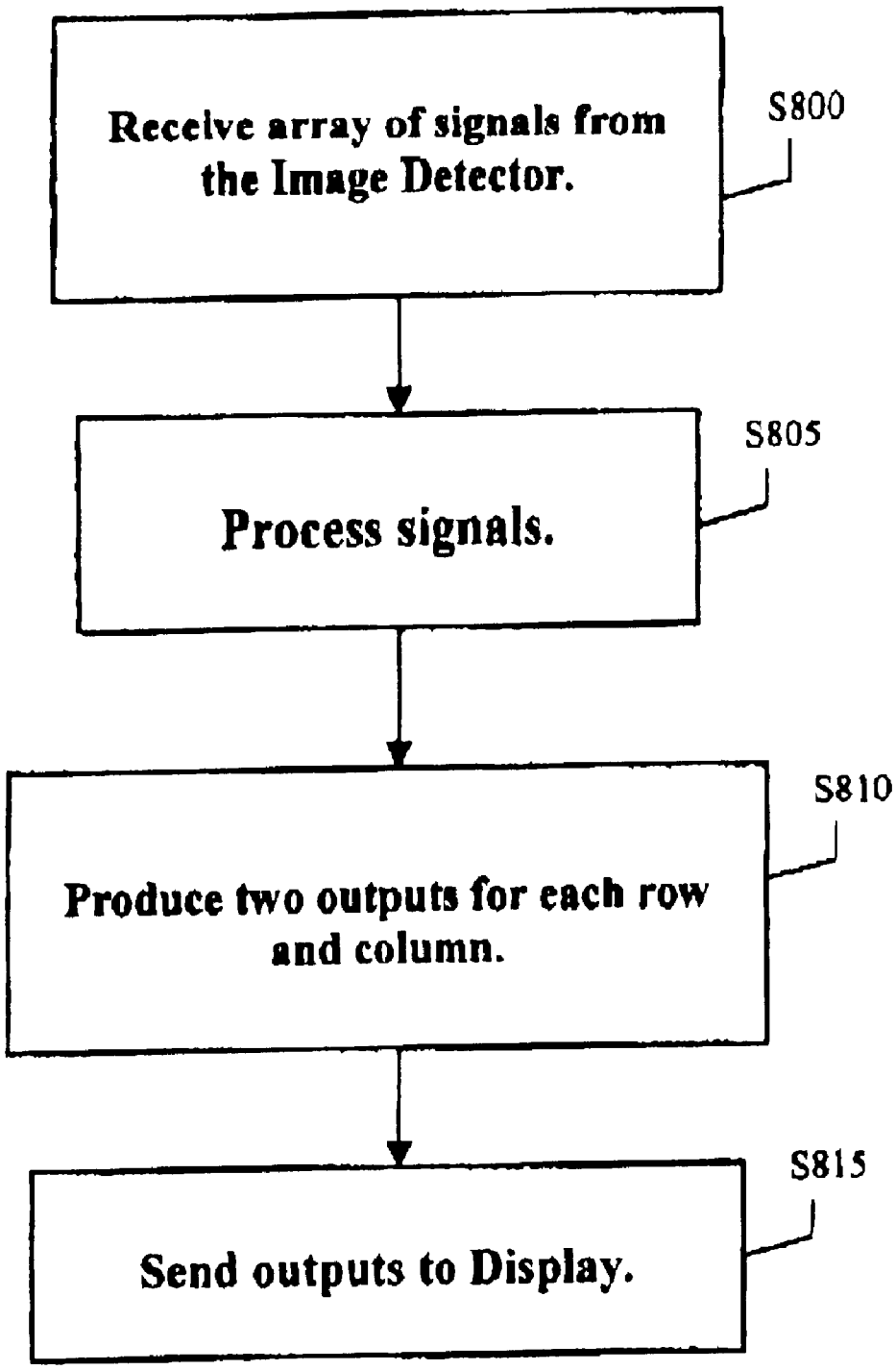
FIG. 8 is a general flowchart of the present method.

FIG. 8 is a general flow chart for the present method. In step S800 the readout circuits of the present system receive an array of signals from an image detector. In step S805 the signals are processed in a way that improves resolution and increases field of view, when compared to traditional readout methods. In step S810, each readout circuit produces two output signals relating to a row or a column of image detection data. In step S815, the output signals are sent to a display unit for visual display.

Figure 9:
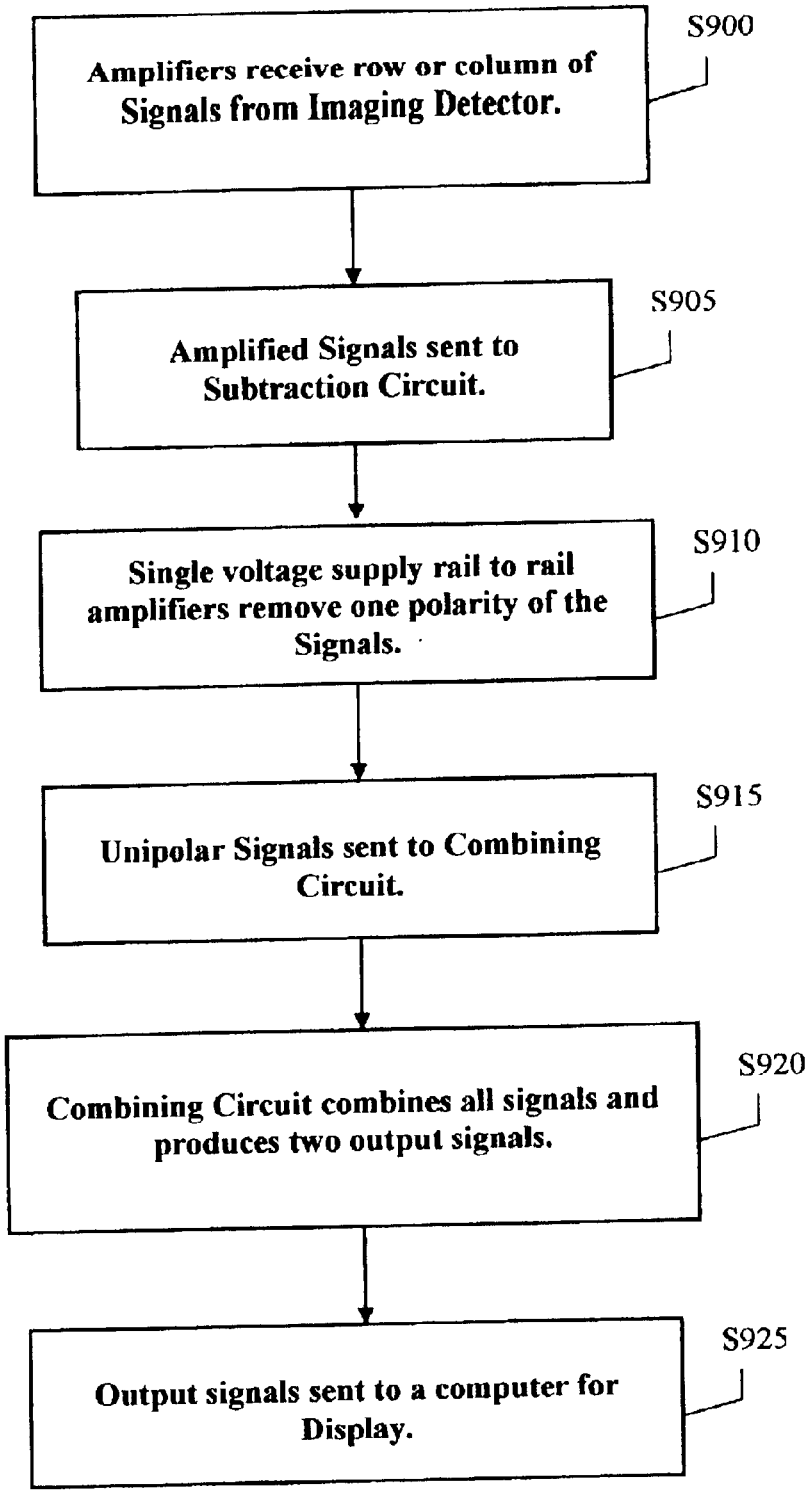
FIG. 9 is a more specific flowchart of the present method.

FIG. 9 is a more detailed flow chart of the present method. In step 900, a row, or column, of signals from the imaging detector are received by the amplifiers. In step 905, the amplified signals are sent to a subtraction circuit that subtracts a portion of the sum of all the signals from each signal, making the signals bipolar. In step 910, these bipolar signals are then sent to rail to rail amplifiers powered by a single voltage supply to eliminate one pole of the signal to make the signals unipolar. In step 915, the unipolar signals are sent to a combining circuit. In step 920, the combining circuit combines all of the unipolar signals and produces two output signals. In step 925, the output signals are sent to a computer to display the image.

The foregoing description of the specific embodiments will so fully reveal the general nature of the invention that others can, by applying current knowledge, readily modify and/or adapt for various applications such specific embodiments without departing from the generic concept Therefore, such adaptations and modifications should and are intended to be comprehended within the meaning and range of equivalents of the disclosed embodiments. It is to be understood that the phraseology of terminology employed herein is for the purpose of description and not of limitation.

We claim:

1. A resistive readout system for imaging detectors comprising: a readout display; and, one or more pairs of readout circuits, wherein each pair of readout circuits comprises an X readout circuit and a Y readout circuit, each X readout circuit receiving a row of outputs from an imaging detector and each Y readout circuit receiving a column of outputs from the imaging detector, each pair of readout circuits comprising:

an X subtractive circuit comprising: amplifiers that receive the row of outputs from the imaging detector, subtraction circuitry that receives a row of signals from the amplifiers, determines a value that is equal to a fraction of a sum of the received signals, and subtracts the value from each signal; single voltage supply rail to rail amplifiers that only transmit one polarity of a result of the subtraction, and, a combining circuit that receives unipolar signals from the rail to rail amplifiers and combines the unipolar signals to produce two X subtractive circuit outputs; and a Y subtractive circuit comprising: amplifiers that receive the column of outputs from the imaging detector; subtraction circuitry that receives a column of signals from the amplifiers, determines a value, equal to a fraction of a sum of the received signals, and subtracts the value from each signal; single voltage supply rail to rail amplifiers that only transmit one polarity of a result of the subtraction; and, a combining circuit that receives unipolar signals from the rail to rail amplifiers and combines the unipolar signals to produce two Y subtractive circuit outputs;

wherein, the two X subtractive circuit outputs and the two Y subtractive outputs are sent to and received by the readout display.

2. The readout system of claim 1, wherein the combining circuit is a resistive charge division circuit.

3. The readout system of claim 1, wherein the combining circuit is a weighted summing circuit.

4. The readout circuit of claim 1, wherein a number of outputs, from the imaging detector and received by the pairs of readout circuits, is 200 or less and the number of outputs from each pair of readout circuits remains constant at four.

5. The readout system of claim 1, wherein the combining circuit is an Anger logic summing circuit.

6. The readout system of claim 1, wherein a sum signal from one of the readout circuits is used as a trigger for a sampling analog to digital card.

7. A method for improving resolution and increasing field of view in a resistive readout system, wherein the readout system receives signals from an imaging detector, processes the signals and transmits the processed signals to a display, the method comprising the steps of:

receiving the signals from the imaging detector in a set of amplifier circuits, wherein each amplifier circuit receives more than one signal from the imaging detector and creates an equal number of amplifier outputs;

transmitting the amplifier outputs to a subtraction circuit that determines a value, equal to a fraction of a sum of the amplifier outputs, and subtracts the value from each signal thereby producing positive and negative signals;

eliminating one polarity from the signals using a rail to rail amplifier operating from a single voltage supply, thereby producing unipolar signals;

sending the unipolar signals to a combining circuit that combines all of the unipolar signals and produces two readout system outputs; and forwarding the readout system outputs to the display.

8. The method of claim 7, wherein the combining circuit is a resistive charge division circuit.

9. The method of claim 7, wherein the combining circuit is a weighted summing circuit.

10. The method of claim 7, wherein a number of signals received from the imaging detector is 200 or less and the number of outputs from each combining circuit remains constant at two.

11. The method of claim 7, wherein the combining circuit is an Anger logic summing circuit.

12. The method of claim 7, wherein a sum signal is used as a trigger for a sampling analog to digital card.

13. A readout circuit for an imaging detector that improves resolution and increases field of view in a display when compared to other readout circuits, the readout circuit comprising:

two or more amplifiers that receive two or more outputs each from the imaging detector;

subtraction circuitry that receives signals from the amplifiers, determines a value, equal to a fraction of a sum of the received signals, and subtracts the value from each signal producing positive and negative signals;

a rail to rail amplifier operating from a single voltage supply that receives the positive and negative signals and produces unipolar signals; and, a combining circuit that receives the unipolar signals and combines all of the unipolar signals to produce two readout circuit outputs, wherein the readout circuit outputs are transmitted to the display.

14. The readout circuit of claim 13, wherein the combining circuit is a relative charge division circuit.

15. The readout circuit of claim 13, wherein the combining circuit is a weighted summing circuit.

16. The readout circuit of claim 13, wherein a total number of outputs received from the imaging detector is 200 or less and the number of outputs from each readout circuit remains constant at two.

17. The readout circuit of claim 13, wherein the combining circuit is an Anger logic summing circuit.

18. The readout circuit of claim 13, wherein a sum signal from the readout circuit is used as a trigger for a sampling analog to digital card.

* * * * *